United States Patent [19]

Damann

[11] Patent Number: 4,735,750

[45] Date of Patent: Apr. 5, 1988

[54] PROCESS AND DEVICE FOR THE DISSOLUTION OF GAS IN LIQUID

[76] Inventor: Franz-Josef Damann, 21, Dammstrasse, D-4791 Lichtenau-Henglarn, Fed. Rep. of Germany

[21] Appl. No.: 908,065

[22] PCT Filed: Oct. 3, 1985

[86] PCT No.: PCT/EP85/00515

§ 371 Date: Sep. 16, 1986

§ 102(e) Date: Sep. 16, 1986

[87] PCT Pub. No.: WO86/04262

PCT Pub. Date: Jul. 31, 1986

[30] Foreign Application Priority Data

Jan. 16, 1985 [DE] Fed. Rep. of Germany ..... 3501175

[51] Int. Cl.[4] ..... B01F 3/04

[52] U.S. Cl. ..... 261/29; 261/36.1; 261/120; 261/115; 261/DIG. 75

[58] Field of Search ..... 261/DIG. 75, 115, 120, 261/36.1, 29

[56] References Cited

U.S. PATENT DOCUMENTS

| | | | |
|---|---|---|---|
| 3,799,511 | 3/1974 | Svantesson | 261/120 |
| 3,865,908 | 2/1975 | Hirshon | 261/DIG. 75 |
| 4,043,771 | 8/1977 | Anand | 261/36 R |
| 4,466,928 | 8/1984 | Kos | 261/DIG. 75 |
| 4,560,474 | 12/1985 | Holik | 261/DIG. 75 |
| 4,564,480 | 1/1986 | Kamelmacher | 261/DIG. 75 |
| 4,597,877 | 7/1986 | Gaia | 261/36.1 |

FOREIGN PATENT DOCUMENTS

| | | | |
|---|---|---|---|
| 2443568 | 3/1975 | Fed. Rep. of Germany | 261/DIG. 75 |
| 370057 | 8/1963 | Switzerland . | |
| 484378 | 2/1976 | U.S.S.R. | 261/DIG. 75 |

*Primary Examiner*—Tim Miles

*Attorney, Agent, or Firm*—William A. Drucker

[57] ABSTRACT

A process and device for mixing and dissolving gas (G) in liquid (F), this latter being introduced under pressure through a nozzle plate (12) into a reaction space (1), whence a mixture of gas (G) and solution (L) flow out through outlets (10) laterally at the bottom into a solution tank (2) and the gas (G) recirculates through inlets (11) at the top near the nozzle plate (12). The solution tank (2) is filled to a level (N1) between the in- and outlets (11, 10) at a medium pressure; the dissolved body of gas (G) is delivered subsequently via a gas flow regulator (5) and the solution (L) is drawn off from the solution tank (2) at a low pressure level via a control valve (24) as a supersaturated solution (UL). An embodiment of the nozzle plate (12) is disclosed with injector nozzles at the edge and mixing nozzles on the inside.

18 Claims, 5 Drawing Sheets

PROCESS AND DEVICE FOR THE DISSOLUTION OF GAS IN LIQUID

The invention relates to a process and device for mixing and dissolving gas in liquid, in which the liquid is supplied under a first, high pressure to a nozzle plate whence it exits at a second, lower pressure into a reaction space which comprises approximately the same cross section as the nozzle plate, of which the length is a multiple of the smallest transverse dimension of the nozzle plate, into which the gas flows in the region of the nozzle plate and out of which a gas/solution mixture flows laterally on the discharge side and is collected in a solution tank in which undissolved gas separates from the solution and from which this gas re-enters the reaction space, sucked in by the liquid stream, and the solution is drawn off from the solution tank.

The process known from Swiss Pat. No. 370057 exhibits the disadvantage that the liquid only comes into contact with the gas for a short time, fractions of seconds, as a fine jet or droplet mist. If necessary, gas bubbles are also introduced into the collected liquid, so that a further dissolution of the gas thereby takes place in the liquid. However, these gas bubbles are relatively large and their residence time in the liquid is therefore also short, such that one run only results in partial saturation of the solution.

It is also known to supply a gas to a liquid under pressure by distributor nozzles. Here also, dissolution of the gas only occurs for as long and to such an extent as is possible before the gas bubbles formed rise to the surface after a few seconds.

The problem on which the invention is based is that of providing a process and a device in which the liquid is intensively swirled and mixed with the gas in such a way that extensive saturation of the liquid thereby occurs at the prevailing pressure without it being necessary repeatedly to circulate the liquid through the nozzles by means of pumps and with it being possible to use relatively wide nozzles of comparatively low resistance in the nozzle plate.

The problem is solved in that the gas/solution mixture is accumulated to a level surrounding the reaction space and the reaction space is immersed to approximately $\frac{2}{3}$ of its length below the level, the solution being drawn off at a third, low pressure level as a supersaturated solution.

Advantageous embodiments are disclosed in the examples and subclaims. The process and the device are characterized by simplicity. No pumps are needed for repeatedly circulating the liquid, and the nozzle bores in the nozzle plate can be relatively wide, so that it is not necessary to filter the liquid supplied of particles and suspended substances, if sea or river water is to be aerated, for example. Even waste water to be purified or other liquids loaded with substances in suspension can be supplied to the device, and it is possible to work with only a few bar pressure so that no high pressure pumps and plant parts are necessary. For purifying baths it is possible, for example, to work directly at water main pressure, so that no pump is required.

It is especially advantageous to construct the nozzles in the nozzle plate in two different embodiments. The nozzles located on the outer ring are drilled cylindrically as power jet nozzles, so that by their high jet speed they exert suction on the surrounding gas. The nozzles located on the inner rings, on the other hand, enlarge conically in a Venturi design, so that the jets leaving them effect an intensive mixing of the liquid with the gas.

The reaction space length is appropriately a multiple of, for example six times, the nozzle plate diameter. The lower outlets are arranged at a height of around 0.5 times the reaction space diameter.

The total nozzle plate flow resistance is selected, for example, so that approximately half the liquid pressure available serves the purpose of nozzle plate throughflow and the other half serves to intensify the dissolution process, if a highly supersaturated solution is to be obtained at the lowest pressure level, which solution has a high temporal durability of many hours and releases the supersaturating gas in extremely small bubbles of approximately 0.05 to 0.15 mm in diameter.

If the pressure drop between the solvent tank and the exit of the solution is made smaller, then the supersaturating gas escapes more quickly in larger bubbles of 0.15 to 2 mm in diameter. Thus, the bubble size and residence time of the dissolved gas in the supersaturated solution can be specifically conformed to the application by simple means.

In a simplified embodiment, provided a mixture and solution of gas in water is to be obtained, the reaction space can also be operated at normal ambient pressure, so that only the internally generated back pressure is effective.

The process and device may be put to very varied use in chemical and biological reactors in closed and open modes of operation. Thus, for water aeration the pumps and device can be mounted on a float and the saturated solution can be drawn off via a pipe or tube line at a predetermined depth and can be mixed into such a large body of water that no gas bubbles arise, as very small gas bubbles are disadvantageous for gill breathers.

For use in medical baths or chemical reactions, on the other hand, the supersaturated solution is appropriately introduced into a liquid in concentrated form; the reduction in solubility wih decreasing pressure on separation of the excess gas results in an extremely fine, emulsion-like gas distribution. This emulsion-like gas distribution from the supersaturated solution leads, if the solution is introduced into larger bodies of liquid, as is the case for example with baths, and after a residence time of several minutes to hours to a complete re-dissolution of this intermediate state, without the small bubbles rising to the surface. Such a gas introduction process is considerably more economical as far as energy and cost are concerned than the direct supplying of gas by means of nozzles. The process and device described are especially suitable for neutralizing or sterilizing waste water with carbonic acid, chlorine or ozone.

If the solution is removed with a small pressure drop, pressure-dependent gas bubbles occur of a specific, predetermined size, which can be conformed to the application. This effect can be used in various ways, for example for flocculating or floating suspended substances out of liquids without further chemical agents.

In the case of purification of waste water loaded with organic materials, for example waste water from the food processing industry, flotation results in rapid purification and removal of suspended substances; the COD value, which stands for the "chemical oxygen demand" for the bilogical decomposition of dissolved organic substances, is simultaneously considerably reduced by supersaturation with oxygen.

With certain uses flocculating, neutralizing and/or oxidizing agents are advantageously introduced into the liquid influx into the reaction chamber, which agents are dispersed extremely homogeneously in the nozzle stream and are transported with the gas bubbles arising on removal of the solution towards the substances to be physically or chemically attacked so that each flocculating agent component which adjoins a gas bubble, exhibits a symbiotic effect on flotatation with the latter. For neutralization an acidic or basic gas, for example carbonic acid or ammonia, can be advantageously introduced, and for sterilization and oxydation the introduction of ozone or chlorine gas is appropriate.

An especially simple embodiment of a device for dissolving air in liquids is obtained if the air is drawn in on the suction side directly with the body of liquid. A compressor installation is then unnecessary.

The process is advantageously suited to the production of fruit juices and other drinks loaded with carbonic acid. The supersaturated solution is preferably bottled under pressure.

Embodiments are shown with the aid of FIGS. 1 to 6.

Figure 1:
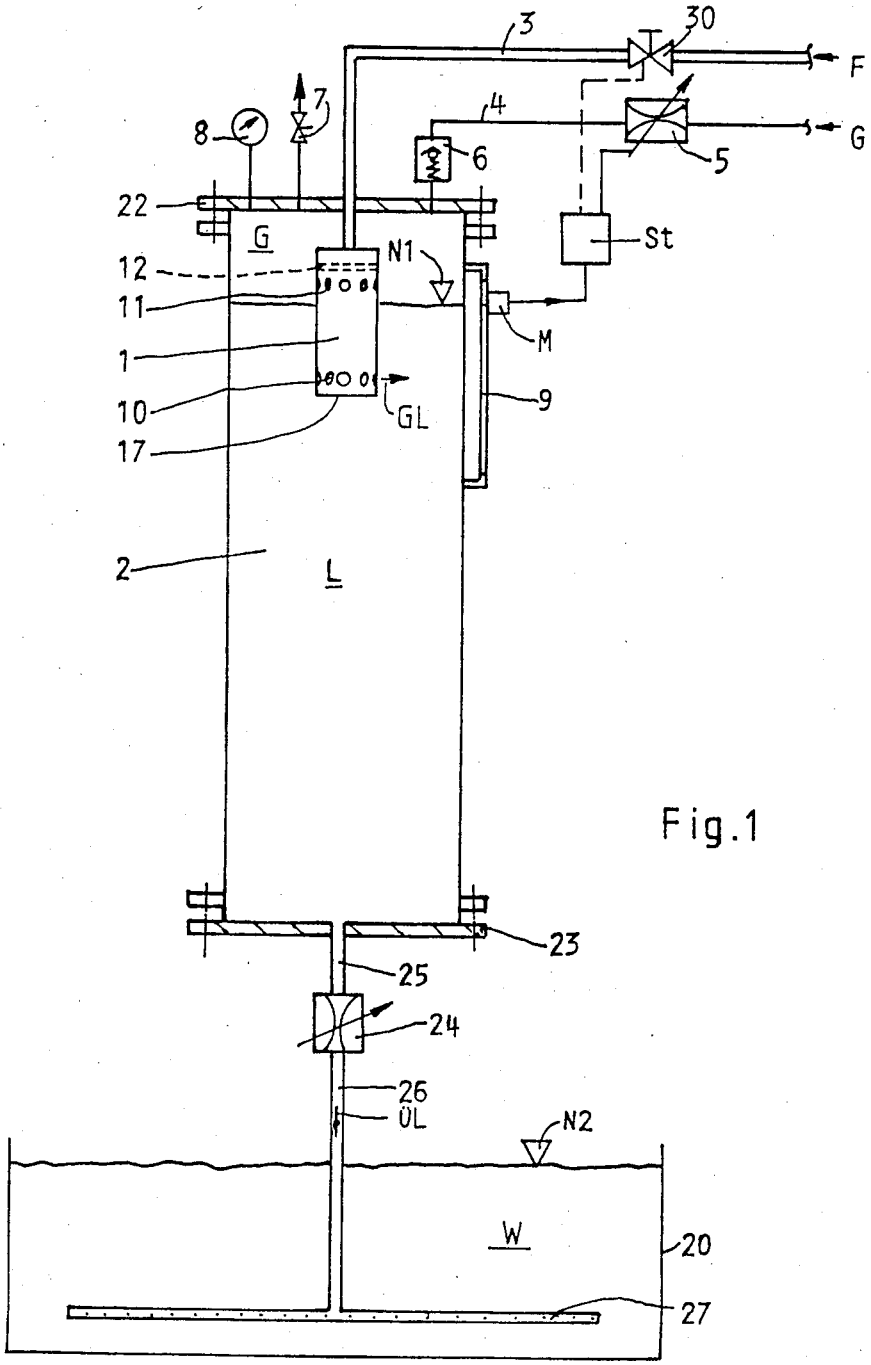
FIG. 1 shows a whole device on a reduced scale and diagrammatically opened up.

FIG. 1 is a diagrammatic view of a mixing and dissolving device. The cylindrical upright reaction space 1 is arranged sufficiently with about ⅔ of its length below the level N1 of the solution L in a solution tank 2, which tank is under a medium pressure and filled to the level N1 with solution L. The liqud F is forced from above through the nozzle plate 12 into the reaction space 1 and collects against the baffle plate 17 at the opposite end of the reaction space 1. Somewhat above the baffle plate 17 there are lateral outlets 10 for the gas/liquid solution mixture GL. Excess gas rises in the form of bubbles and collects above the level N1 whence it is once again sucked via inlets 11 arranged laterally at the top of the reaction space 1 by the relatively low pressure which the jet of liquid creates there and is mixed thoroughly with the liquid. The quantity of the gas G consumed through dissolution is fed via a gas flow regulator 5, the gas inlet 4 and a non-return valve 6 to the solution tank 2 through its upper closure plate 22 and is continuously replaced at medium pressure.

The pressure can be monitored on the manometer 8. If a gas other than air is used the air extraction valve 7 can be used for initial dearation. Otherwise the air present in the tank can be used up first. Maintenance of the level N1 can be observed with the viewing glass 9. When this is reached the gas flow is connected up. During continuous operation the solution L is conducted away through the lower closure plate 23 of the solution tank 2 by a discharge pipe 25 via a control valve 24 and is ready for the desired application. For example, the solution L passes into the supersaturated state owing to the pressure drop at the control valve 24, and the supersaturated solution UL is supplied by the duct 26 to a distributor tube 27 provided with bores and positioned at the bottom of a tank 20 filled with water W or a liquid, where the emulsion-like gas/solution mixture divides. The tank 20 is, for example, filled with waste water to be aerated. As the gas/solution mixture is lighter than the waste water it gradually rises and the extremely finely distributed gas dissolves in the still unsaturated waste water. This process takes minutes; only a little gas rises to the surface in the form of small bubbles if the level N2 lies several decimeters above the distributor tube.

The settings of the gas flow regulator 5 and the control valve 24 are relatively non-critical, as the level N1 is self-stabilizing to a certain extent, since the mixing intensity and thereby the gas consumption increases as the level N1 rises. Each time, the liquid F, which is fed through the valve 30 via the pipe 3 to the nozzle plate 12 and whose quantity is substantially determined by the resistance of the nozzle plate 12, must be saturated by the appropriate gas flow. It has proven advantageous for the high pressure of the liquid F to be reduced from 6 bar, for example, to a medium pressure behind the nozzle plate 12 of, for example, 3 bar, that is to give the flow resistances of the nozzle plate 12 and the control valve 24 equal values. This applies so long as a supersaturated solution UL is needed for use.

If lower supersaturation is to be obtained, an especially if larger gas bubbles are desired for the exit of the dissolved gas from the solution, the pressure drop at the control valve should be correspondingly reduced. Furthermore, the lower pressure on exit from the distributor tube 27, as it occurs in flowing water for example, or the higher pressure on entry into pressure reactors should be taken into consideration. If large pressure fluctuations are to be reckoned with on the liquid supply side it is appropriate for the gas flowregulator 5 to be controlled in the known way by a control device St in dependence upon the level N1, for example by a ball float or a thermal or optical indicator M, and thus to form a superordinated control circuit.

Figure 2:
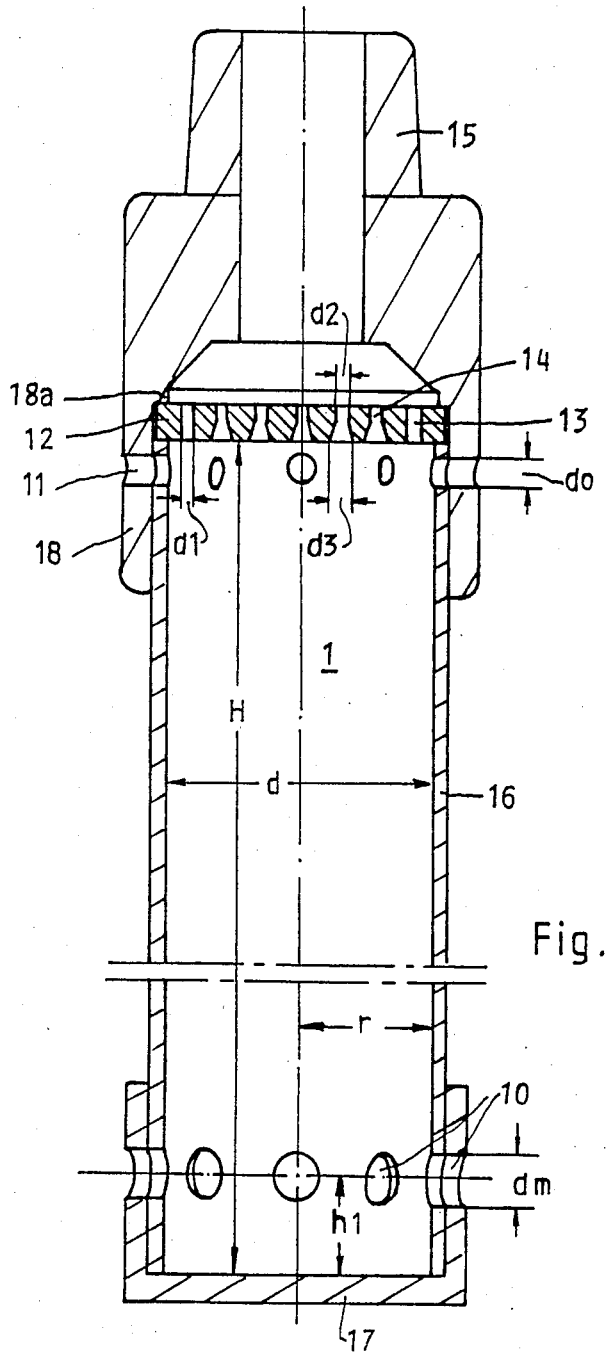
FIG. 2 is a vertical section of a reaction space.

An advantageous embodiment of the reaction space 1 is shown in FIG. 2. The cylinder 16 carries at its upper end a pipe connection 15 and a screw sleeve 18 with an internal shoulder **18*a* by means of which the nozzle plate 12 is held on the end of the cylinder. Dismantling for purposes of inspection is thus easily possible. At its lower end the cylinder 16 is closed by the baffle plate 17. The length H of the cylinder is approximately 6 to 8 times its diameter d. At the height hl from the baffle plate 17, which height corresponds approximately to the radius r of the cylinder, there are provided 8 bores as outlets 10, the diameters dm of which bores are so dimensioned according to the total cross section that only a slight flow resistance arises for the gas/liquid solution mixture. A little below the nozzle plate 12 there are arranged on all sides eight further bores in the cylinder acting as inlets 11, there diameters do being so dimensioned according to the total cross section that they are approximately ⅓ of the cross section of the outlets 10**.

Figure 3:
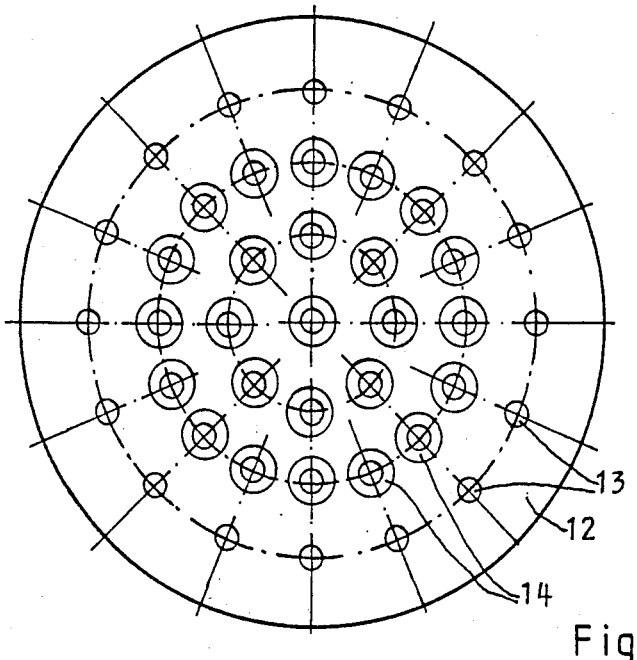
FIG. 3 shows a perforated plate from below.
Figure 4:
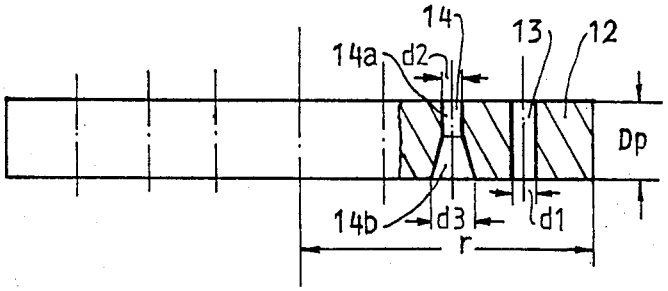
FIG. 4 is a radial section of a perforated plate.

An advantageous embodiment of the nozzle plate 12 is shown in FIGS. 3 and 4. The nozzles 13, 14 are arranged in radially equidistant circles in the quantities 1, 8, 16, 16 from the centre outwards. The outer 16 nozzle bores 13 are cylindrical and have a diameter dl of for example 2 mm if the radius r of the reaction space is 15 mm. They serve to create the rapid injector jets. The mixing nozzles 14 have, on the inlet side, a cylindrical bore **14*a* with the inlet diameter d2, which in the example is also 2 mm, and they have, on the outlet side, a conical enlargement 14*b*** to the outlet diameter d3 which is approximately double the inlet diameter d2.

The nozzle plate thickness Dp is approximately ¼ of the radius r of the plate.

Other nozzle arrangements and size ratios can be inferred by one skilled in the art from the example, according to the desired throughput and pressure ratio. Thus, small apparatuses for aerating aquaria can be made completely of plastics with, for example, an injection-moulded nozzle plate. The nozzle plate can also be constructed rectangularly. The size of the bores is then determined according to the smallest transverse measurement, as is the reaction space length.

Figure 5:
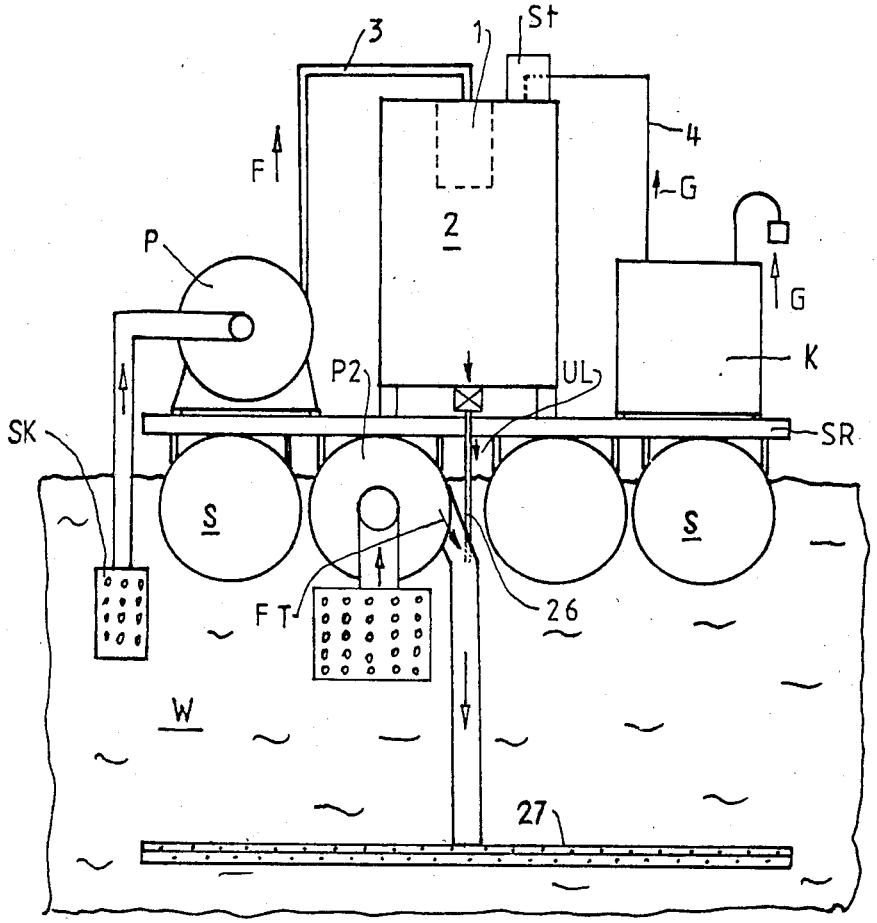
FIG. 5 shows a water aeration device.

A large embodiment of the device for aerating sizable bodies of water is shown in FIG. 5. The solution tank 2 is mounted, together with the mixing and dissolving device, on a frame SR, below which floats S are situated. Moreover, a pump P is mounted on the frame which pump sucks water through a suction basket S and forces it through the inlet 3 into the mixing device. A compressor K forces compressed air via the pipe 4 into the device. The pump and compressor drives, which are also situated on the frame, are not shown in detail. The whole device floats on the water W and has its own drive (not shown), or it is taken in tow by a watercraft. The supersaturated solution is pushed via a tube 26 into the large-area distributor pipe 27, which is towed along at a predetermined depth. Here it must be ensured that the towing speed of the device in the stagnant body of water or the flow speed of the water and the introduction surface of the distributor pipe 27 are bit enough for the solution to be absorbed free of micro-bubbles, as micro-bubbles with a diameter of less than 0.2 mm would be damaging to gill breathers. Alternatively, it is also possible to mix a side liquid stream FT which is substantially larger than the stream through the reaction space with the supersaturated solution UL before the distributor pipe 27, for bubble-free distribution of the supersaturated solution UL. Another low pressure pump P2 serves to do this. Thus bodies of water can be specifically reactivated and the living organisms therein can be prevented from dying off.

Figure 6:
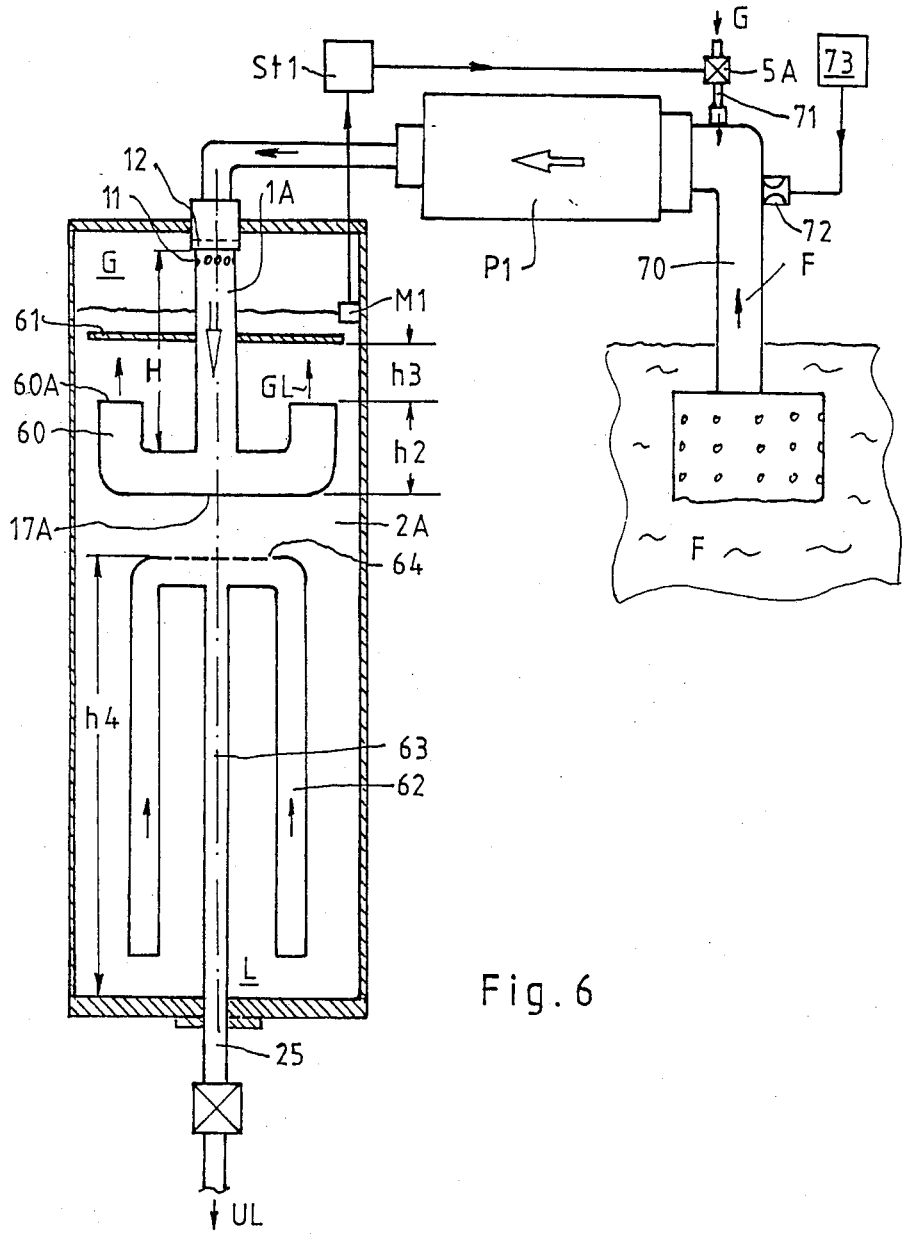
FIG. 6 shows a laterally-opened second embodiment of a whole device, diagrammatic in side view and partially diagrammatic where reduced in scale.

The compressor K can be replaced by a compressed gas reservoir, or air can also be sucked in by the pump P, as FIG. 6 shows.

This enables the equipment to be considerably simplified.

FIG. 6 shows an alternative embodiment to FIG. 1 which, with the same output, requires a smaller structural length and smaller tank volume. The reaction space 1A is closed at the top by the nozzle plate 12 and has the gas inlets 11 to the side thereof, and at the lower end there are arranged, to the side of the other baffle plate 17A, preferably two pipe fittings 60 which are curved upwards, whose cross section corresponds approximately to the cross section of the reaction space 1A and whose length h2 corresponds to approximately a ⅓ of the reaction space length H. Above the outlet ends 60A of the pipe fittings 60, at a distance h3 corresponding to approximately ¼ of the reaction space length H, there is arranged an upper baffle plate 61, which directs the gas/gas solution stream GL downwards and projects width wise beyond the outlets 60A.

The level of the solution L in the tank reaches to a little over the upper baffle plate 61. In the lower tank area there is located, upstream of the outlet pipe 25, an upstanding discharge pipe 63 whose length h4 is approximately twice that of the reaction space length H and which branches into several, for example two, downwardly directed collecting pipes 62 ending near the floor of the tank. In the top end of the discharge pipe 63 there are arranged a number of narrow bores 64 from which separating gas can rise. On the one hand the dissolution process is improved by the detours at the end of the reaction space 1A and in front of the outlet pipe and on the other hand purification of the solution L of gas bubbles is made possible within a smaller volume.

The deflectors can also be replaced by one skilled in the art by other similarly operating constructions. Moreover, FIG. 6 shows diagrammatically an alternative embodiment of the gas feed line, which is suitable for introducing air. In such a case an air inlet 71 is connected in the suction pipe fittings 70 of the fluids pump P1, which air inlet 1 ends in a dosaging valve 5A by means which the air influx of the liquid F to the pump is regulated. Pumps, which are to be arranged only slightly below the water surface, are especially suited to this type of operation, as they have to operate at only a low suction subpressure. The dosaging valve 5A is either set to a fixed flow quantity or is controlled by a level regulating device St2 which is connected to a level sensor M1.

A dosaging valve 72 is also connected to the suction pipe 70, and is joined to a storage vessel 73 for a flocculating agent.

A combination of a different selection of the partial solutions given in the Figs. and subclaims is within the scope of one skilled in the art.

I claim:

1. A process for mixing and dissolving a gas in a liquid comprising the steps of supplying liquid at a first, high-pressure to a nozzle plate and causing it to exit at a second lower pressure to enter a reaction space which is surrounded by and immersed to approximately two thirds of its length in solution present in a solution tank, supplying gas to the reaction space in the region of the nozzle plate, causing mixtures of gas and solution to leave the reaction space laterally and to enter the solution tank wherein undissolved gas separates from solution to be drawn into the reaction space by interaction with liquid delivered thereto, and removing solution from the solution tank at a third, lower pressure as a supersaturated solution, the arrangement being such that the cross-section of the reaction space is approximately equal to that of the nozzle plate and the length of the reaction space is a multiple of the least transverse dimension of the nozzle plate.

2. A process as claimed in claim 1 wherein high-speed, narrow liquid jets are injected into the reaction space along the wall area thereof and relatively slow moving atomising mixing jets of liquid are directed into the reaction space at locations intermediate the wall area of the reaction space.

3. A process as claimed in claim 1 wherein the gas comprises at least partially chlorine or ozone.

4. A process as claimed in claim 1 wherein the gas comprises at least partially carbonic acid or ammonia.

5. A process as claimed in claim 1 wherein the pressure difference between the said second and third pressures is such that a predetermined average gas bubble size is achieved on exit of the supersaturated solution from the solution tank, wherein the pressure difference between the said first and second pressures is maintained at a value not less than the pressure difference between the said second and third pressures, and that the flow resistance of solution entering the solution tank is substantially equal to the flow resistance of solution leaving the solution tank.

6. A process as claimed in claim 5 wherein the ratio between the rates at which gas and liquid flows are supplied to either the reaction space or to the solution tank is fixed to correspond to the dissolving power of the said second pressure and that the ratio is controlled in dependence upon the level of liquid present in the solution tank, the gas flow rate varying in direct proportion to any variation occurring in the level of liquid present in the solution tank.

7. A process as claimed in claim 6 wherein the pressure drop between the said second and third pressures is maintained such that gas bubbles of diameter from 0.2 to 2.0 mm are produced on exit of the supersaturated solution from the tank.

8. A process as claimed in claim 7 wherein the pressure drop between the said second and third pressures is maintained such that gas bubbles of diameter less than 0.2mm are produced on exit of the supersaturated solution from the solution tank, the stream of supersaturated solution being mixed with a further liquid stream before its discharge into a body of water so that bubbles dissolve extensively before discharge.

9. Apparatus for mixing and dissolving a gas in a liquid comprising a nozzle plate formed with at least one outer row of injector nozzles and at least one radially inner row of mixing nozzles, the nozzle plate being connected to receive liquid at a first high pressure and to discharge liquid into a reaction space at a second lower pressure, the reaction space including a plurality of gas inlets in the region of the nozzle plate and a plurality of gas/liquid outlets at its end remote from the nozzle plate, and the length of the reaction space being a multiple of the least transverse dimension of the nozzle plate wherein each injector nozzle is formed with a cylindrical bore whose length is a multiple of its diameter and wherein each mixing nozzle has a cylindrical entry section and a conical exit section.

10. Apparatus as claimed in claim 9 wherein the maximum diameter of the exit section of each mixing nozzle is approximately twice that of the diameter of the entry section thereof.

11. Apparatus for mixing and dissolving a gas in a liquid comprising a nozzle plate connected to receive liquid at a first high pressure and formed with at least one outer row of injector nozzles and at least one radially inner row of mixing nozzles, a reaction cylinder positioned to receive liquid at a second lower pressure from the nozzle plate, the reaction cylinder being closed at one end by a baffle plate and including a plurality of outlet bores positioned at a height above the baffle plate which corresponds approximately to the radius of the reaction cylinder, the reaction cylinder further comprising a plurality of inlet bores connected to receive gas in the vicinity of the nozzle plate, the total cross-section of which inlet bores amounts approximately to $\frac{1}{3}$ of the total cross-section of the said outlet bores.

12. Apparatus for mixing and dissolving a gas in a liquid comprising a nozzle plate formed with at least one outer row of injector nozzles and at least one radially inner row of mixing nozzles, the nozzle plate being connected to receive liquid at a first high pressure and to discharge liquid into a reaction space at a second lower pressure, the reaction space including a plurality of gas inlets in the region of the nozzle plate and a plurality of gas/liquid outlets at its end remote from the nozzle plate, and the length of the reaction space being a multiple of the least transverse dimension of the nozzle plate wherein the reaction spaced is closed by a first baffle plate which includes two upwardly extending pipe fittings whose height approximates to $\frac{1}{3}$ of the height of the reaction space and above whose outlet ends is mounted a second baffle plate at a distance approximating to $\frac{1}{4}$ of the height of the reaction space.

13. Apparatus for mixing and dissolving a gas in a liquid comprising a nozzle plate formed with at least one outer row of injector nozzles and at least one radially inner row of mixing nozzles, the nozzle plate being connected to receive liquid at a first high pressure and to discharge liquid into a reaction space at a second lower pressure, the reaction space including a plurality of gas inlets in the region of the nozzle plate and a plurality of gas/liquid outlets at its end remote from the nozzle plate, and the length of the reaction space being a multiple of the least transverse dimension of the nozzle plate wherein the reaction space is located within an upper section of a solution tank whose volume is a multiple of that of the reaction cylinder and whose length is multiple of the length of the reaction cylinder; wherein gas is supplied to the solution tank via a pipe line including a flow regulator; wherein supersaturated solution leaves the solution tank through an outlet pipe including a control valve; and wherein a vertically aligned discharge pipe of a length approximating to twice the length of the reaction space is positioned within the solution tank upstream of the outlet pipe, the vertically aligned discharge pipe communicating at its upper end with a plurality of collecting pipes which extend downwardly towards the floor of the solution tank and in whose upper closing walls are formed narrow bores which define gas flow passages.

14. Apparatus as claimed in claim 13 wherein the outlet pipe from the solution tank is connected to a filling plant.

15. Apparatus as claimed in claim 13 wherein the solution tank includes an indicator for indicating the level of solution present within the solution tank, the indicator being connected to a control device operable to output a control signal either to the said gas flow regulator or to a dosage valve for regulating the flow of liquid to said reaction space respectively to regulate the flow of gas or liquid in a sense to maintain the solution present in the solution tank at a predetermined level.

16. Apparatus as claimed in claim 15 further comprising a float on which it is mounted together with a pump and a compressor, the pump being connected to suck liquid from a suction basket located in the vicinity of the float and to supply such liquid through a conduit to the nozzle plate, and the compressor being connected to supply gas under pressure through the said gas pipe line, the supersaturated solution being discharged from the apparatus through a discharge pipe at a predetermined depth below the float.

17. Apparatus for mixing and dissolving a gas in a liquid comprising a nozzle plate formed with at least one outer row of injector nozzles and at least one radially inner row of mixing nozzles, the nozzle plate being connected to receive liquid at a first high pressure and to discharge liquid into a reaction space at a second lower pressure, the reaction space including a plurality of gas inlets in the region of the nozzle plate and a plurality of gas/liquid outlets at its end remote from the nozzle plate, and the length of the reaction space being a multiple of the least transverse dimension of the nozzle plate further comprising a pump connected to supply gas to the nozzle plate, the inlet conduit to the pump being placed in communication with a level indicator positioned within the solution tank by means of a pipe and a controllable dosage valve, the valve being controlled to maintain a constant level of solution within the solution tank.

18. Apparatus as claimed in claim 17 wherein the inlet conduit of the pump is connected to the outlet of a storage vessel for a flocculating agent, a dosage valve being positioned between the inlet conduit of the pump and the outlet of the storage vessel.

* * * * *